US005212918A

United States Patent [19]

Newhouse et al.

[11] Patent Number: 5,212,918

[45] Date of Patent: May 25, 1993

[54] SUPPORT PANEL BASE COVER

[75] Inventors: Thomas J. Newhouse, Grand Rapids; Paul G. Dame, Holland, both of Mich.

[73] Assignee: Herman Miller, Inc., Zeeland, Mich.

[21] Appl. No.: 710,717

[22] Filed: Jun. 5, 1991

[51] Int. Cl.[5] ..... E04B 2/82; E05D 15/06

[52] U.S. Cl. ..... 52/126.3; 52/238.1; 52/242; 52/220.7; 160/195; 160/351

[58] Field of Search ..... 52/126.3, 126.4, 238.1, 52/241, 242, 586, 585, 782, 122, 221, 239; 160/181, 187, 194, 195, 135, 351

[56] References Cited

U.S. PATENT DOCUMENTS

| | | | |
|---|---|---|---|
| 2,240,484 | 5/1941 | Anderson | 189/34 |
| 2,963,131 | 12/1960 | Brockway . | |
| 3,274,741 | 9/1966 | Neagle | 52/242 |
| 3,487,598 | 1/1970 | Lopina | 52/126.4 |
| 3,566,559 | 3/1971 | Dickson | 51/122 |
| 3,605,851 | 9/1971 | Miles et al. | 160/135 |
| 3,623,290 | 11/1971 | Downing | 52/481 |
| 3,979,864 | 9/1976 | Tillié52 | 126.4 X/ |
| 4,103,463 | 8/1978 | Dixon | 52/122 |
| 4,158,936 | 6/1979 | Fulton | 52/242 |
| 4,406,101 | 9/1983 | Heidmann | 52/242 X |
| 4,407,101 | 10/1983 | Propst et al. | 52/126.3 |
| 4,430,832 | 2/1984 | Kaiser et al. | 52/238.1 |
| 4,567,699 | 2/1986 | McClellan | 52/241 X |
| 4,625,476 | 12/1986 | Shimada | 52/586 X |
| 4,662,131 | 5/1987 | Glockenstein | 52/126.4 |
| 4,700,517 | 10/1987 | Stöhr | 52/126.4 X |

FOREIGN PATENT DOCUMENTS

| | | | |
|---|---|---|---|
| 0084209 | 7/1983 | European Pat. Off. . | |
| 0313486 | 4/1989 | European Pat. Off. | 52/126.1 |
| 0375641 | 6/1990 | European Pat. Off. . | |
| 1033880 | 7/1958 | Fed. Rep. of Germany | 52/126.4 |
| 488070 | 5/1970 | Switzerland | 52/126.4 |

*Primary Examiner*—David A. Scherbel
*Assistant Examiner*—Kien Nguyen
*Attorney, Agent, or Firm*—Willian Brinks Olds Hofer Gilson & Lione

[57] ABSTRACT

A support panel base cover is used with a support panel and a wall panel system. The support panel is mounted to a wall panel and has a bottom edge spaced apart from a floor. At least one vertically adjustable leg is adapted to cooperate with the support panel and the floor to support said panel on the floor. The support panel also is adapted to receive a cover internally therein. The cover is moveable relative to the support panel and the leg and is adapted to rest on the floor. In addition, the cover has a height sufficient to substantially conceal the space between the bottom edge of the support panel and the floor.

19 Claims, 3 Drawing Sheets

SUPPORT PANEL BASE COVER

BACKGROUND OF THE INVENTION

The present invention relates generally to wall panel systems, and more particularly, to a cover which conceals the space between a floor and a bottom edge of a support panel mounted to a wall panel.

The cover may be used with a support panel of a type described in U.S. patent application Ser. No. 07/588,364, filed Sep. 25, 1990, and the support panel may be mounted to a panel system of a type described in U.S. patent application Ser. No. 07/596,352, filed Oct. 12, 1990, U.S. patent application Ser. No. 07/580,300, filed Sep. 10, 1990, or U.S. patent application Ser. No. 07/670,240, filed Mar. 15, 1991, the disclosures of which are specifically incorportated herein by reference.

In some panel systems, a work surface extends horizontally from a vertical wall panel. If the worksurface is relatively small, a bracket or strut provides a sufficient brace. If the worksurface is large, however, vertical support panels may be required to provide the necessary support for the worksurface. Such support panels generally extend perpendicular from the wall panel. These panels may also be used to support the wall panel system itself, especially if there are numerous wall panels in the system.

In order to accommodate for variations in the height of a floor, the support panels often have an adjustable glide extending from a bottom edge thereof. To provide access to the glide so it can be adjusted, the bottom edge of the support panel is usually spaced apart from the floor. This space tends to be unattractive and also detracts from the privacy of a workstation by allowing noise, drafts, etc. to enter from outside the workstation.

A vertically adjustable wall panel is disclose in U.S. Pat. No. 4,407,101 (Propst). In order to adjust the height of the wall panel, an adjustable bolt is provided which is connected at one end to the wall panel and at the other end to a foot assembly. The adjustment bolt is externally threaded in opposite directions so that when the bolt is turned, the wall panel moves vertically relative to the foot assembly. To conceal the adjustment bolt, elongated covers are pivotally attached to the wall panel. In order to gain access to the adjustment bolt, the covers are pivoted outward. In addition, the covers move vertically with the wall panel, and the foot assembly remains on the floor when the bolt is turned.

In U.S. Pat. No. 3,566,559 (Dickson), a bottom edge of a wall panel is connected to a channel having side flanges and inner guide flanges extending downwardly parallel to the panel. A bottom plate rests on a floor and has upwardly extending flanges which slideably engage the channel guide flanges. A threaded fastener cooperates with the channel and bottom plate to vertically adjust the wall panel. There is no apparent means for gaining access to the fastener. Since the bottom plate remains on the floor when the panel is vertically adjusted, both the bottom plate flanges and the channel side flanges act as covers which conceal the space between the panel and the floor.

A vertically adjustable post assembly for use with a wall panel system is disclosed in U.S. Pat. No. 2,963,131 (Brockway). A square sleeve, which is positioned about the lower end of the post assembly to act as a cover, remains on a floor when the post is vertically adjusted from underneath the floor.

In U.S. Pat. No. 4,103,463 (Dixon), a portable wall panel system is disclosed in which a vertically adjustable, channel shaped seal assembly is provided for engagement with a floor. When the seal assembly is raised by turning an adjustment bolt, a ball caster engages the floor to rollingly support the panel on a floor. In this raised position, there is an open space between the panel system and the floor. To provide access to the adjustment bolt, a recess is formed in the wall panel.

SUMMARY OF THE INVENTION

Briefly stated, the invention is directed to a cover which conceals the space between a support panel and a floor. The support panel has a bottom edge which is spaced apart from a floor and means for receiving cover means internally therein. Vertically adjustable leg means are adapted to cooperate with the support panel and the floor to support said panel on the floor. The cover means is adapted to rest on the floor and is moveable relative to the support panel and the leg means. In addition, the cover means has a height sufficient to substantially conceal the space between the bottom edge of the support panel and the floor.

In a preferred embodiment, the support panel has a relatively narrow channel extending upward from the bottom edge thereof. The channel preferably spans a substantial length of the support panel and terminates in a cavity adjacent a front edge of the panel. The cavity preferably has a width greater than the channel, a height substantially the same as the channel, and an end surface spaced apart from the front edge of the support panel. The support panel also has a hole extending upward from a top surface of the cavity and a threaded insert positioned inside the hole adjacent the support panel cavity.

The cover means preferably includes an elongated foot, a guide plate extending vertically upward from substantially the longitudinal center of said foot, and a block portion extending outward from a front end of the guide plate and upward from a top surface of the foot. The foot is substantially hollow and has bottom edges which rest on the floor and define a substantially open bottom face. The guide plate is adapted to slideably fit in the support panel channel, and the block member is adapted to slideably fit in the support panel cavity. In addition, the block member has a core therein defined by side walls and a top wall. The top wall of the block member has an aperture therethrough in alignment with the support panel hole.

The leg means preferably comprises a glide bolt having a head, a substantially smooth portion, and a threaded end portion. The smooth portion extends through the core in the block portion of the cover means. The threaded end portion means with the threaded insert and extends into the support panel hole.

In operation of the aforesaid preferred embodiment, the cover means is lifted upward such that the guide plate slides into the support panel channel and the block portion slides into the support panel cavity. The glide bolt is vertically adjusted so that the head thereof rests on the floor to secure the support panel. The cover means is released, and said cover means falls downward until the bottom edges of the foot contact the floor, thus concealing the space between the bottom edge of the support panel and the floor.

The present invention provides significant advantages over other covers which conceal the space between a support panel or wall panel and a floor. The ease with which the cover means is lifted upward provides ready access for adjustment of the glide bolt. The cover means also attractively conceals the space between the bottom edge of a panel and the floor for various heights of the panel relative to the floor. Also, the cover means is adapted to conceal a non-uniform space between the bottom edge of the support panel and the floor resulting from an uneven floor surface.

The present invention, together with further objects and advantages, will be best understood by reference to the following detailed description taken in conjunction with the accompanying drawings.

DETAILED DESCRIPTION OF THE PREFERRED EMBODIMENTS

Figures 1, 6:
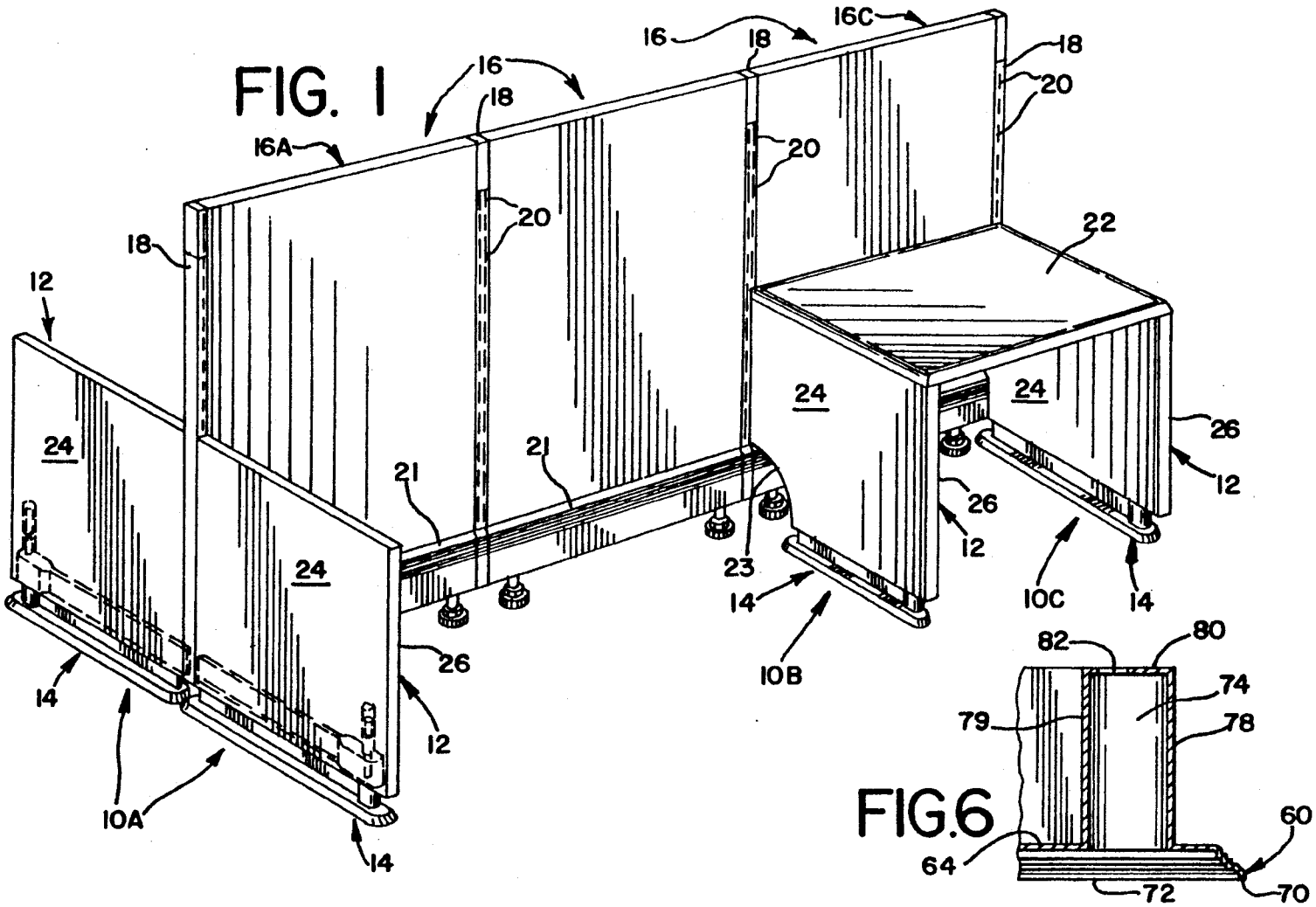
FIG. 1 is a perspective view of a preferred embodiment of the invention showing a plurality of interconnected wall panels, a plurality of support panel assemblies extending therefrom, and a worksurface.
FIG. 6 is a fragmentary view of a cover showing a block portion and foot in cross-section.

Referring to the drawings, FIGS. 1–6 show a preferred embodiment of the invention. In FIG. 1, a plurality of support panel assemblies 10, each including a vertical support panel 12 and a cover 14, extend perpendicularly from a plurality of interconnected vertical wall panels 16. Each wall panel 16 has side edge portions 18 with a plurality of vertical slots 20 therein, and a raceway 21 extending outward from a bottom portion thereof. Support panel assemblies 10A are shown extending perpendicularly from an end wall panel 16A in opposite directions to maintain the wall panels 16 in an upright position. Support panel assemblies 10B and 10C are shown extending perpendicularly in the same direction from end wall panel 16B to support the wall panels 16 and to support a worksurface 22 placed horizontally upon support members 10B and 10C.

Figure 3:
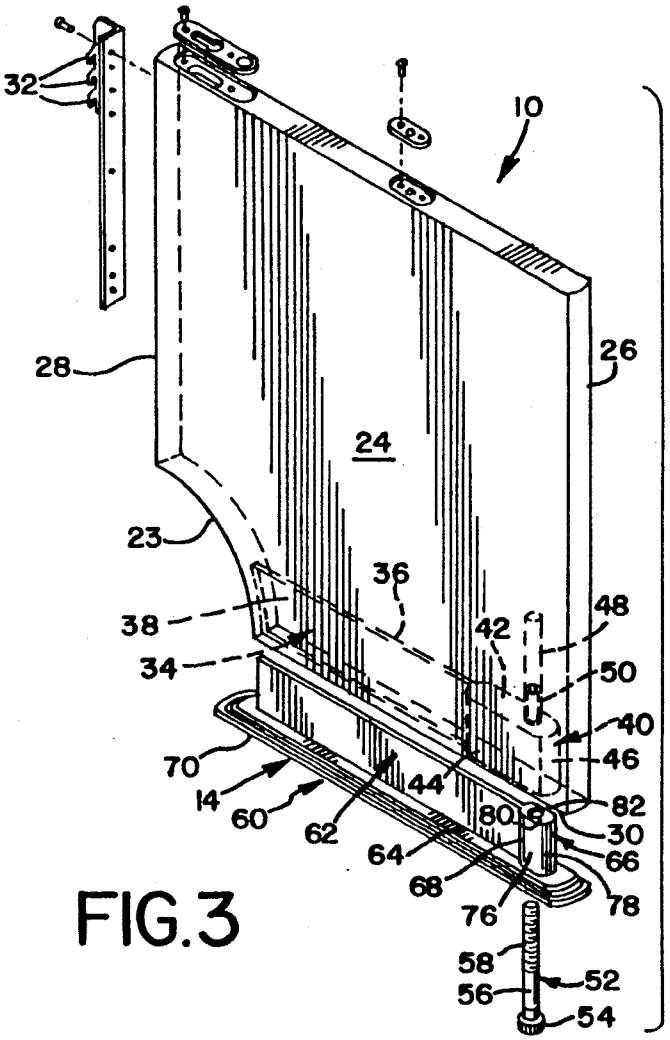
FIG. 3 is a perspective view of a preferred embodiment of the invention showing an intermediate support panel assembly with a cut-out portion in a support panel.
Figure 2:
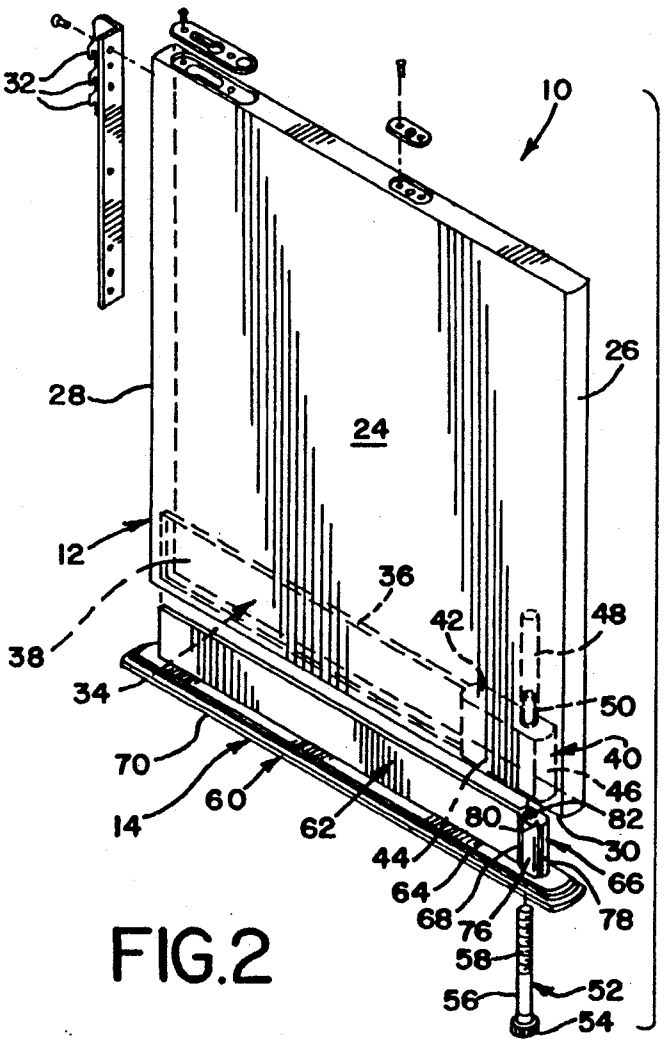
FIG. 2 is a perspective view of a preferred embodiment of the invention showing an end support panel assembly.

Any number of wall panels 16 can be arranged in a desired configuration to suit the needs of a particular office environment. Preferably, support panel assemblies 10 extend in opposite directions from the outermost edge portions 18 of each end wall panel 16 in a wall panel system. In addition, the support panel assemblies 10 can extend from any of the interconnecting end portions 18 of wall panels 16 to support a worksurface 22 at a desired location. In such a position, support panels 12 are provided with a recess 23 to provide clearance for the raceway 21, as support panel assembly 10C is shown in FIGS. 1 and 3. The support panels 12 can also have conventional shelving attached thereto, or may have the typical features of a desk, such as drawers, cable management features, or the like.

As best shown in FIGS. 2–5, each support panel 12 has side surfaces 24, a front edge 26, a back edge 28, and a bottom edge 30 spaced apart from a floor. To secure the support panels 12 to the wall panels 16, a plurality of vertically aligned hook members 32 extend from the back edge 28 of the support panels and are inserted into the slots 20 in the side edge portions 18 of wall panels 16. The support panels 12 can be mounted to the wall panels 16 by any conventional attachment means, such as bolts, screws, clips or the like.

Each support panel 12 has a relatively narrow channel 34 extending upward from bottom edge 30. The channel 34 is defined by a top surface 36 and side surfaces 38 which are parallel to the side surfaces 24 of the support panel 12. Channel 30 spans longitudinally from back edge 28 of the support panel 12 to a cavity 40 formed in the panel adjacent the front edge 26. The cavity 40 is defined by a top surface 42, side surfaces 44, and an end surface 46 which is spaced apart from the front edge 26 of the support panel 12. The top surface 42 of the cavity 40 is the same height as the top surface 36 of the channel 30, and the width of the cavity 40 between side surfaces 44 is greater than the width of the channel 34 between side surfaces 38. Although the foregoing configuration of channel 34 and cavity 40 is the preferred embodiment for receiving cover 14, any shape, size, or number of interior chambers may be provided as long as cover 14 slideably fits therein.

In addition, a hole 48 extends upward from the top surface 42 of the cavity 40, and a threaded insert 50 is positioned inside the hole 48 adjacent the top surface 42 to receive a glide bolt 52. The glide bolt 52 has a head 54, a substantially smooth portion 56, and a threaded end portion 58 which mates with the threaded insert 50 and extends into the hole 48. To accommodate for variations in the height of a floor,, the glide bolt 52 is turned until the head 54 contacts the floor. Any vertically adjustable leg means adapted to cooperate with the support panel 12 and the floor to support the panel can be provided. For example, the hole 48 can be threaded rather than using the insert 50, or an adjustable set screw assembly may be provided which has an end bearing against the top surface 42 of cavity 40. If channel 34 is made wide enough, any number of adjustable leg means can be positioned along the length of top surface 36, although it is desirable to have at least one such leg means adjacent the front edge 26.

The cover 14 includes an elongated floor 60, a guide plate 62 extending vertically upward from a top surface 64 of the foot 60 in the longitudinal center thereof, and a block portion 66 extending outward from a front end 68 of the guide plate 62 and upward from the top surface 64 of the foot 60. The guide plate 62 has a width approximately the same as the support panel channel 34 such that the guide plate slideably fits in the channel. Likewise, the block portion 66 has a width approximately the same as the cavity 40 and a length shorter than the cavity such that the block portion slideably fits in the cavity.

Figure 5:
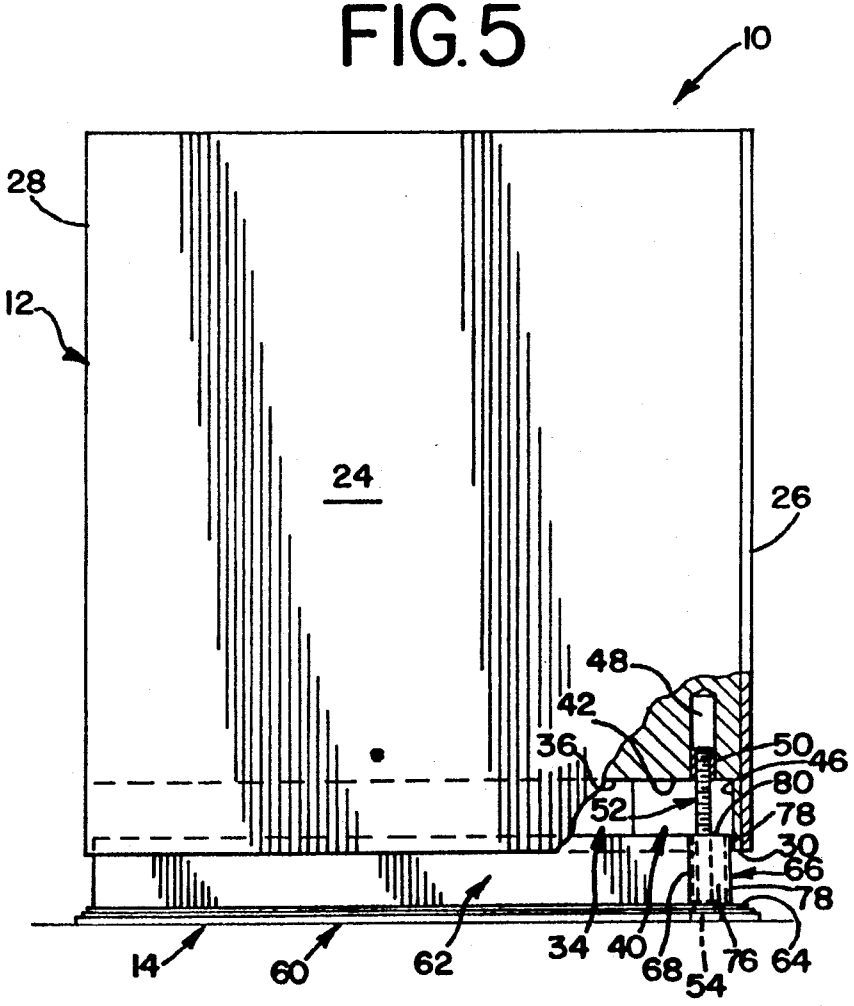
FIG. 5 is a side view of a preferred embodiment of the invention showing the support panel partially in section and in a relatively low position.
Figure 4:
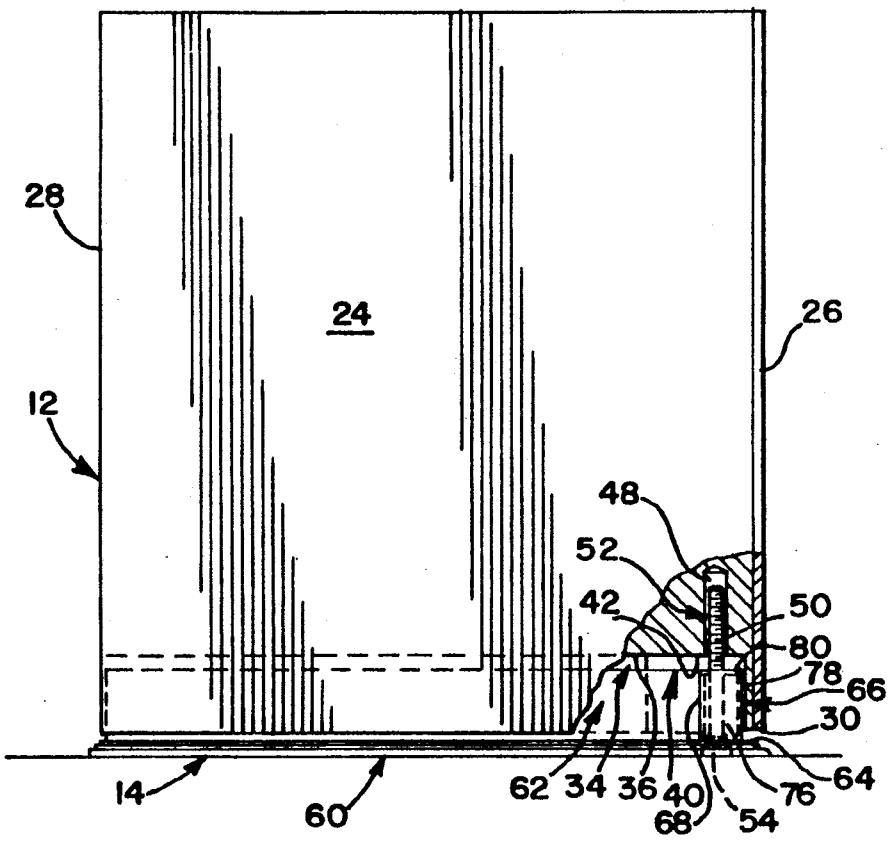
FIG. 4 is a side view of a preferred embodiment of the invention showing the support panel partially in section and in a relatively high position.

Referring now to FIGS. 4 and 5, a support panel assembly 10 is shown in FIG. 4 with the support panel 12 in a lowermost position, and in FIG. 5 with the support panel 12 in an uppermost position. As best shown in FIG. 4, the heights of guide plate 62 and block portion 66 are low enough relative to the heights of channel 34 and cavity 40 to provide a clearance between the cover 14 and the top surfaces 36 and 42 of channel 34 and cavity 40 when the support panel 12 is in a lowermost position, thus allowing the cover 14 to be lifted for gaining access to the glide bolt 52. In addition, the distance between the top surface 64 of foot 60 and the bottom edge 30 of the support panel 12 is sufficient to allow the cover 14 to be lifted to gain access to the glide bolt 52 when the support panel 12 is in the lowermost position. As best shown in FIG. 5, the guide plate 62 and block portion 66 are also of a sufficient height to conceal the space between the bottom edge 30 of support panel 12 and the floor when the support panel 12 is in the uppermost position. The heights of the guide plate 62 and block portion 66 relative to the channel 34 and cavity 40, and the heights of the foot 60 relative to the bottom edge 30 of the support panel 12, also allow the cover 14 to be positioned at an angel within the support panel 12 such that a non-uniform space between the bottom edge 30 of the support panel 12 and a sloped floor can be concealed.

The cover 14 can be any shape or size which slideably fits within an interior chamber formed in the support panel 12, as long as the cover 14 can be lifted to gain access to the guide bolt 52, and as long as the space between the support panel 12 and the floor is concealed when the support panel 12 is in an uppermost position. However, it is desirable for the cover to have substantially the same width as the chamber to provide guidance when sliding the cover in the chamber. For example, the cover and chamber can have a uniform width, or the cover can have a plurality of upwardly extending glide plates slideably engaging the side surfaces of a channel. In addition, the height of the chamber can be inclined such that the forward end of the cover may be raised to gain access to the glide bolt when the support panel is in a lowermost position. Preferably, the cover 14 is made of injection-molded plastic.

As shown in FIG. 6, the foot 60 is hollow and has bottom edges 70 which rest on the floor and define a substantially open bottom face 72 so that the glide bolt 52 can be positioned therein. Also to accommodate the glide bolt 52, the block portion 66 has a core 74 therein defined by side walls 76, a front wall 78, a back wall 79, and a top wall 80. The top wall 80 has an aperture 82 therethrough in alignment with the support panel hole 48. The foot 60 can be any configuration which stabilizes the cover 14, and can have an aperture therein for slideably receiving the glide bolt 52 rather than being hollow. In addition, the block portion 66 can have a single aperture therethrough for slideably receiving the glide bolt 52 rather than having the core 74 formed therein. However, the added space provided by the hollow foot and the core in the block portion allows the cover to be lifted easily, thus facilitating access to the glide bolt.

In operation, support panel 12 is mounted to the side edge portion 18 of a wall panel 16. Cover 14 is lifted upward such that the guide plate 62 slides into the support panel channel 34 and the block portion 66 slides into the support panel cavity 40. The glide bolt 52 is vertically adjusted so that the head 54 thereof rests on the floor to secure the support panel 12. The cover 14 is released, and the cover falls downward until the bottom edges 70 of foot 60 contact the floor.

Thus, an attractive apparatus which conceals the space between the bottom edge of a support panel and a floor and also provides ready access to an adjustment bolt is provided.

Although the present invention has been described with reference to preferred embodiment, workers skilled in the art will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An apparatus for use with a wall panel system, comprising:

a support panel mounted to a wall panel, said support panel having a bottom edge spaced apart from a floor and an interior chamber extending vertically upward from said bottom edge and spanning a substantial length of the panel, said interior chamber including a relatively narrow channel and a cavity having a width greater than the channel;

vertically adjustable leg means positioned in said support panel cavity and adapted to cooperate with the support panel and the floor to support said panel on the floor, whereby the leg means is adjusted to compensate for variations in the floor height; and cover means having a lower portion adapted to rest upon the floor and an upper portion adapted to slide up into said channel in the support panel to provide access to the leg means, said cover means including a cavity for receiving the leg means and being adapted to substantially fill the space between the support panel and the floor;

whereby the cover means is adapted to be lifted upward to provide access to the vertically adjustable leg means and adapted to fall downward when released until the lower portion thereof contacts the floor, thus filling the space between the bottom edge of the support panel and the floor.

2. The apparatus of claim 1, wherein the leg means comprises a glide bolt having a threaded end portion and a head which contacts the floor, and the support panel further comprises means for receiving the threaded end portion of said glide bolt.

3. The apparatus of claim 2, wherein the means for receiving the threaded portion of the guide bolt comprises a hole extending vertically upward in the support panel and a threaded insert positioned inside said hole.

4. The apparatus of claim 1, wherein the cover means comprises an elongated foot, a guide plate extending vertically upward from substantially the longitudinal center of said foot, and a block portion extending outward from a front end of the guide plate and upward from a top surface of the floor, the guide plate being adapted to slideably fit in the support panel channel, and the block portion being adapted to slideably fit in the support panel cavity.

5. The apparatus of claim 4, wherein the block portion and the foot have an aperture therethrough of a sufficient size to slideably receive the leg means.

6. The apparatus of claim 4, wherein the block portion of the cover means has side walls and a top wall defining a cavity, and said top wall has an aperture therethrough in alignment with the means for receiving the leg means in the support panel.

7. The apparatus of claim 6, wherein the leg means comprises a glide bolt having a threaded end portion and a head which contacts the floor, a hole extends vertically upward from a top surface of the cavity, and a threaded insert is positioned inside said hole for receiving the threaded end portion of the bolt.

8. The apparatus of claim 7, wherein the foot is substantially hollow and bottom edges thereof define a substantially open bottom face, and at least a portion of said bottom edges rest on the floor.

9. The apparatus of claim 1, wherein the support panel has a cut-out portion in a lowermost corner thereof adjacent the wall panel to provide clearance for a raceway extending outward from a bottom portion of said wall panel.

10. An apparatus for use with a wall panel system, comprising:

a support panel having side surfaces, a front edge, a back edge adapted to be mounted to a wall panel, a bottom edge spaced apart from a floor, and an interior chamber therein extending vertically upward from the bottom edge thereof;

vertically adjustable leg means adapted to cooperate with the support panel and the floor to support said panel on the floor, whereby the leg means is adjusted to compensate for variations in the floor height; and a cover moveable relative to the support panel and the leg means to provide access to said leg means, said cover including a substantially vertical portion adapted to fit into the interior chamber of the support panel, and a foot portion extending laterally from a bottom edge of said vertical portion for stabilizing the cover on the floor, the vertical portion and foot portion having apertures therethrough of a sufficient size to slideably receive the leg means, and the vertical portion having a sufficient height to substantially conceal the space between the bottom edge of the support panel and the floor;

whereby the cover is lifted upward while the leg means is vertically adjusted to contact the floor and support the panel, the cover is released, and said cover falls downward until the foot portion contacts the floor, thus concealing the space between the bottom edge of the support panel and the floor.

11. The apparatus of claim 10, wherein the leg means comprises a glide bolt having a threaded end portion and a head which contacts the floor, and the support panel further comprises means for receiving the threaded end portion of said glide bolt.

12. The apparatus of claim 10, wherein the interior chamber comprises a relatively narrow channel defined by a top surface and side surfaces parallel to the side surfaces of the support panel, said channel spanning a substantial length of the panel and terminating in a cavity having a width greater than the channel and an end surface spaced apart from the front edge of the support panel.

13. The apparatus of claim 12, wherein the foot portion is elongated, the cover vertical portion comprises a guide plate extending vertically upward from substantially the longitudinal center of the foot portion, and a block portion extending outward from a front end of the guide plate and upward from a top surface of the foot portion, the guide plate being adapted to slideably fit in the support panel channel, and the block portion being adapted to slideably fit in the support panel cavity.

14. The apparatus of claim 13, wherein the leg means comprises a glide bolt having a threaded end portion and a head which contacts the floor, a hole extends vertically upward from a top surface of the cavity, and a threaded insert is positioned inside said hole for receiving the threaded end portion of the bolt.

15. The apparatus of claim 14, wherein the block portion has a core therein defined by side walls and a top wall, and the top wall has an aperture therethrough in alignment with the support panel hole for slideably receiving the leg means.

16. The apparatus of claim 15, wherein the foot portion is substantially hollow and bottom edges thereof define a substantially open bottom face, and at least a portion of said bottom edges rest on the floor.

17. The apparatus of claim 10, wherein the support panel has a cut-out portion in a lowermost corner thereof adjacent the wall panel to provide clearance for a raceway extending outward from a bottom portion of said wall panel.

18. An apparatus for use with a wall panel system including a vertical support panel positioned substantially perpendicularly to a vertical wall panel, the support panel having side surfaces, a front edge, a back edge adapted to be mounted to a wall panel, and a bottom edge spaced apart from a floor, the apparatus comprising:

the support panel having a relatively narrow channel extending upward from the bottom edge thereof along a substantial length thereof and terminating in a cavity adjacent the front edge of the panel, the channel being defined by a top surface and side surfaces parallel to the side surfaces of the support panel, the cavity having a width greater than the channel, a height substantially the same as the channel, and an end surface spaced apart from the front edge of the support panel, the support panel also having a hole extending upward from a top surface of the cavity;

a threaded insert positioned inside the hole adjacent the support panel cavity;

a cover moveable relative to the support panel to provide access to a glide bolt, the cover including an elongated foot, a guide plate extending vertically upward from substantially the longitudinal center of said foot, and a block portion extending outward from a front end of the guide plate and upward from a top surface of the foot, the guide plate and block portion having a sufficient height to substantially conceal the space between the bottom edge of the support panel and the floor, the foot being substantially hollow and having bottom edges which rest on the floor and define a substantially open bottom face, the guide plate being adapted to slideably fit in the support panel channel, and the block portion being adapted to slideably fit in the support panel cavity, said block portion having a core therein defined by side walls and a top wall, said top wall having an aperture therethrough in alignment with the support panel hole; and a glide bolt having a head, a substantially smooth portion extending into the core in the block portion of the cover, and a threaded end portion mating with the threaded insert and extending into the support panel hole;

whereby the cover is lifted upward such that the guide plate slides into the support panel channel and the block portion slides into the support panel cavity, the glide bolt is vertically adjusted so that the head thereof rests on the floor to secure the support panel, the cover is released, and said cover fall downward until the bottom edges of the foot contact the floor, thus concealing the space between the bottom edge of the support panel and the floor.

19. The apparatus of claim 18, wherein the support panel has a cut-out portion in a lowermost corner thereof adjacent the wall panel to provide clearance for a raceway extending outward from a bottom portion of said wall panel.

* * * * *

UNITED STATES PATENT AND TRADEMARK OFFICE

CERTIFICATE OF CORRECTION

PATENT NO. : 5,212,918

DATED : May 25, 1993

INVENTOR(S) : Thomas J. Newhouse et al.

It is certified that error appears in the above-indentified patent and that said Letters Patent is hereby corrected as shown below:

ON THE TITLE PAGE, item [56]

Column 1, under the heading "U.S. PATENT DOCUMENTS", in the eighth line, please delete "Tilliié52" and substitute therefor --Tillié--.

Column 1, line 18, please delete "work surface" and substitute therefor --worksurface--.

Column 1, line 36, please delete "disclose" and substitute therefor --disclosed--.

Column 2, line 54, after "portion" please delete "means" and substitute therefor --mates--.

Column 4, line 36, after "floor," please delete ",".

Column 5, line 15, please delete "angel" and substitute therefor --angle--.

UNITED STATES PATENT AND TRADEMARK OFFICE

CERTIFICATE OF CORRECTION

PATENT NO. : 5,212,918

DATED : May 25, 1993

INVENTOR(S) : Thomas J. Newhouse et al.

It is certified that error appears in the above-indentified patent and that said Letters Patent is hereby corrected as shown below:

Claim 4, line 6, please delete "floor" and substitute therefor --foot--.

Signed and Sealed this

Nineteenth Day of July, 1994

Bruce Lehman

*Attest:*

BRUCE LEHMAN

*Attesting Officer*

*Commissioner of Patents and Trademarks*